US008471769B2

(12) United States Patent
Wolf

(10) Patent No.: US 8,471,769 B2
(45) Date of Patent: Jun. 25, 2013

(54) ANTENNA HAVING PLANAR CONDUCTING ELEMENTS, ONE OF WHICH HAS A PLURALITY OF ELECTROMAGNETIC RADIATORS AND AN OPEN SLOT

(75) Inventor: Forrest D. Wolf, Reno, NV (US)

(73) Assignee: Pinyon Technologies, Inc., Reno, NV (US)

( * ) Notice: Subject to any disclaimer, the term of this patent is extended or adjusted under 35 U.S.C. 154(b) by 305 days.

(21) Appl. No.: 12/938,375

(22) Filed: Nov. 2, 2010

(65) Prior Publication Data

US 2011/0273337 A1 Nov. 10, 2011

Related U.S. Application Data

(63) Continuation-in-part of application No. 12/777,103, filed on May 10, 2010.

(51) Int. Cl.
*H01Q 1/38* (2006.01)

(52) U.S. Cl.
USPC ..... 343/700 MS; 343/767; 343/702

(58) Field of Classification Search
USPC ..... 343/700 MS, 702, 767, 770
See application file for complete search history.

(56) References Cited

U.S. PATENT DOCUMENTS

| | | | | |
|---|---|---|---|---|
| 6,018,324 | A | 1/2000 | Kitchener | |
| 6,847,329 | B2 * | 1/2005 | Ikegaya et al. | 343/702 |
| 7,684,781 | B2 * | 3/2010 | Saito et al. | 455/333 |
| 2002/0000940 | A1 | 1/2002 | Moren et al. | |
| 2003/0231139 | A1 | 12/2003 | Tai et al. | |
| 2005/0035919 | A1 | 2/2005 | Yang et al. | |
| 2008/0198084 | A1 | 8/2008 | Yeap | |

OTHER PUBLICATIONS

International Search Report and Written Opinion dated Aug. 29, 2011 for PCT Application No. PCT/US2011/035963, 11 pp.

* cited by examiner

*Primary Examiner* — Hoang V Nguyen
(74) *Attorney, Agent, or Firm* — Holland & Hart LLP

(57) ABSTRACT

An antenna includes a dielectric material having i) a first side opposite a second side, and ii) a conductive via therein. A first planar conducting element is on the first side of the dielectric material and has an electrical connection to the conductive via. A second planar conducting element is also on the first side of the dielectric material. A gap electrically isolates the first and second planar conducting elements from each other. An electrical microstrip feed line on the second side of the dielectric material electrically connects to the conductive via and has a route that extends from the conductive via, to across the gap, to under the second planar conducting element. The first planar conducting element has a plurality of electromagnetic radiators, each having dimensions that cause it to resonate over a range of frequencies that differs from a range of frequencies over which an adjacent radiator resonates. At least first and second of the radiators bound an open slot in the first planar conducting element.

31 Claims, 10 Drawing Sheets

ANTENNA HAVING PLANAR CONDUCTING ELEMENTS, ONE OF WHICH HAS A PLURALITY OF ELECTROMAGNETIC RADIATORS AND AN OPEN SLOT

CROSS-REFERENCE TO RELATED APPLICATION

This application is a continuation-in-part of prior application Ser. No. 12/777,103, filed May 10, 2010, which application is hereby incorporated by reference for all that it discloses.

BACKGROUND

A dipole antenna is a useful antenna for receiving or transmitting radio frequency radiation. However, a dipole antenna operates in only one frequency band, and antennas that operate in multiple bands are sometimes needed. For example, an antenna that operates in multiple bands is often needed for Worldwide Interoperability for Microwave Access (WiMAX), Ultra Wideband (UWB), Wireless Fidelity (Wi-Fi), ZigBee and Long Term Evolution (LTE) applications.

SUMMARY

In one embodiment, an antenna comprises a dielectric material having i) a first side opposite a second side, and ii) a conductive via therein. A first planar conducting element is on the first side of the dielectric material and has an electrical connection to the conductive via. A second planar conducting element is also on the first side of the dielectric material, and is electrically isolated from the first planar conducting element by a gap. An electrical microstrip feed line is on the second side of the dielectric material. The electrical microstrip feed line electrically connects to the conductive via and has a route extending from the conductive via, to across the gap, to under the second planar conducting element. The second planar conducting element provides a reference plane for both the electrical microstrip feed line and the first planar conducting element. The first planar conducting element has a plurality of electromagnetic radiators. Each radiator has dimensions that cause it to resonate over a range of frequencies that differs from a range of frequencies over which an adjacent radiator resonates. At least first and second of the radiators bound an open slot in the first planar conducting element.

In another embodiment, an antenna comprises a dielectric material having i) a first side opposite a second side, and ii) a conductive via therein. A first planar conducting element is on the first side of the dielectric material. The first planar conducting element has i) an electrical connection to the conductive via, and ii) a first edge opposite a second edge. The second edge is a stepped edge, wherein each step defines an electromagnetic radiator or an open slot in the first planar conducting element. A second planar conducting element is also on the first side of the dielectric material, and is electrically isolated from the first planar conducting element by a gap. The first edge of the first planar conducting element abuts the gap. An electrical microstrip feed line is on the second side of the dielectric material. The electrical microstrip feed line electrically connects to the conductive via and has a route extending from the conductive via, to across the gap, to under the second planar conducting element. The second planar conducting element provides a reference plane for both the electrical microstrip feed line and the first planar conducting element.

In yet another embodiment, an antenna comprises a dielectric material having i) a first side opposite a second side, and ii) a conductive via therein. A first planar conducting element is on the first side of the dielectric material. The first planar conducting element has i) an electrical connection to the conductive via, ii) a plurality of electromagnetic radiators, and iii) an open slot bounded by at least first and second of the electromagnetic radiators. A second planar conducting element is also on the first side of the dielectric material, and is electrically isolated from the first planar conducting element by a gap. An electrical microstrip feed line is on the second side of the dielectric material. The electrical microstrip feed line electrically connects to the conductive via and has a route extending from the conductive via, to across the gap, to under the second planar conducting element. The second planar conducting element provides a reference plane for both the electrical microstrip feed line and the first planar conducting element.

Other embodiments are also disclosed.

BRIEF DESCRIPTION OF THE DRAWINGS

Illustrative embodiments of the invention are illustrated in the drawings, in which.

In the drawings, like reference numbers in different figures are used to indicate the existence of like (or similar) elements in different figures.

DETAILED DESCRIPTION

Figure 1:
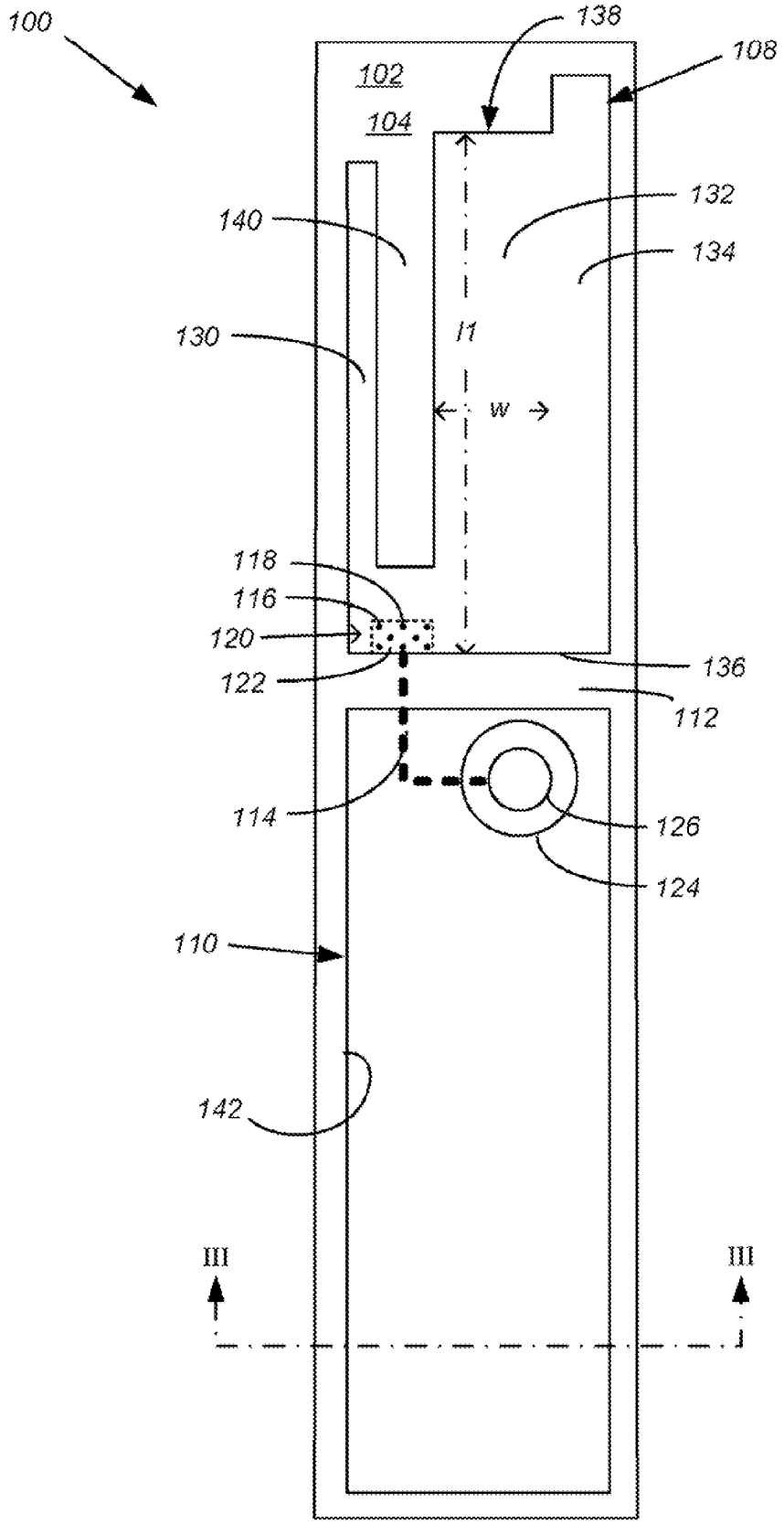
FIGS. 1-3 illustrate a first exemplary embodiment of an antenna having first and second planar conducting elements, one of which comprises a plurality of electromagnetic radiators and an open slot and is electrically connected to an electrical microstrip feed line.
Figure 2:
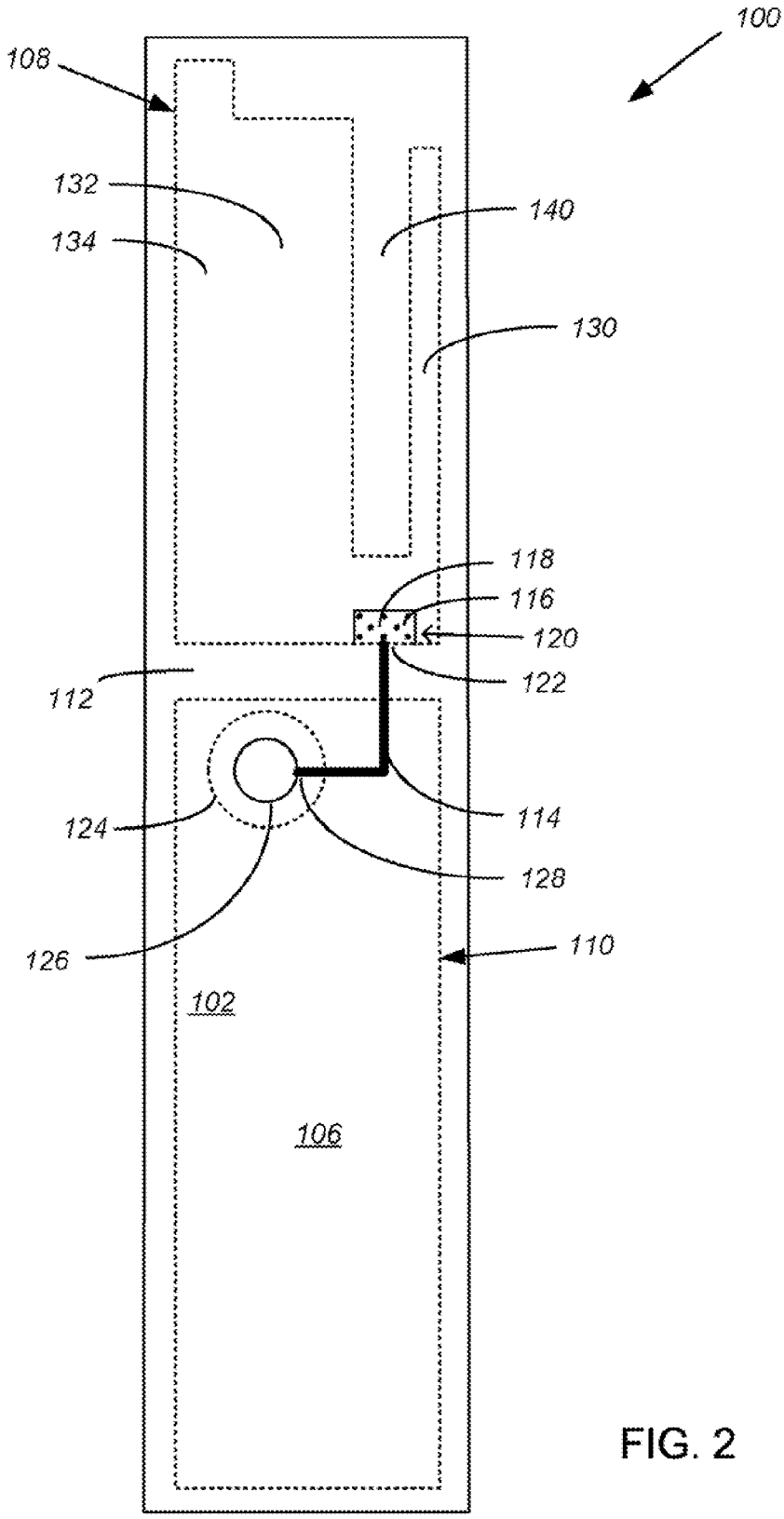
Figure 3:
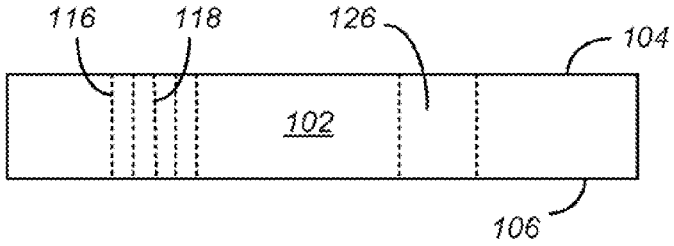

FIGS. 1-3 illustrate a first exemplary embodiment of an antenna 100. The antenna 100 comprises a dielectric material 102 having a first side 104 and a second side 106 (see FIG. 3). The second side 106 is opposite the first side 104. By way of example, the dielectric material 102 may be formed of (or may comprise) FR4, plastic, glass, ceramic, or composite materials such as those containing silica or hydrocarbon. The thickness of the dielectric material 102 may vary, but in some embodiments is equal to (or about equal to) 0.060" (1.524 millimeters).

First and second planar conducting elements 108, 110 (FIG. 1) are disposed on the first side 104 of the dielectric material 102. The first and second planar conducting elements 108, 110 are separated by a gap 112 that electrically isolates the first planar conducting element 108 from the second planar conducting element 110. By way of example, each of the first and second planar conducting elements 108, 110 may be metallic and formed of (or may comprise) copper, aluminum or gold. In some cases, the first and second planar conducting elements 108, 110 may be printed or otherwise formed on the dielectric material 102 using, for example, printed circuit board construction techniques; or, the first and second planar conducting elements 108, 110 may be attached to the dielectric material 102 using, for example, an adhesive.

An electrical microstrip feed line 114 (FIG. 2) is disposed on the second side 106 of the dielectric material 102. By way of example, the electrical microstrip feed line 114 may be printed or otherwise formed on the dielectric material 102 using, for example, printed circuit board construction techniques; or, the electrical microstrip feed line may be attached to the dielectric material 102 using, for example, an adhesive.

The dielectric material 102 has a plurality of conductive vias (e.g., vias 116, 118) therein, with each of the conductive vias 116, 118 being positioned proximate others of the conductive vias at a connection site 120. The first planar conducting element 108 and the electrical microstrip feed line 114 are each electrically connected to the plurality of conductive vias 116, 118, and are thereby electrically connected to one another. By way of example, the first planar conducting element 108 is electrically connected directly to the plurality of conductive vias 116, 118, whereas the electrical microstrip feed line 114 is electrically connected to the plurality of conductive vias 116, 118 by a rectangular conductive pad 122 that connects the electrical microstrip feed line 114 to the plurality of conductive vias 116, 118. In some cases, the conductive pad 122 can be eliminated. However, the conductive pad 122 will typically be wider than the electrical microstrip feed line 114, thereby providing a larger area for connecting the electrical microstrip feed line 114 to the first planar conducting element 108. The larger area enables the electrical microstrip feed line 114 to be connected to the first planar conducting element 108 using more conductive vias 116, 118 than when the surface area of the electrical microstrip feed line 114, alone, is used to connect the electrical microstrip feed line 114 to the first planar conductor element 108. The use of more conductive vias 116, 118 typically improves current flow between the electrical microstrip feed line 114 and the first planar conducting element 108, which increased current flow is typically associated with an improved antenna bandwidth.

As best shown in FIG. 2, the electrical microstrip feed line 114 has a route that extends from the plurality of conductive vias 116, 118, to across the gap 112 (that is, the route crosses the gap 112), to under the second planar conducting element 110. In this manner, the second planar conducting element 110 provides a reference plane for the electrical microstrip feed line 114.

The first planar conducting element 108 has a plurality of electromagnetic radiators. By way of example, the first planar conducting element 108 is shown to have three electromagnetic radiators 130, 132, 134. In other embodiments, the first planar conducting element 108 could have any number of two or more electromagnetic radiators.

Each of the radiators 130, 132, 134 has dimensions (e.g., radiator 132 has dimensions "w" and "l") that cause it to resonate over a range of frequencies that differs from a range of frequencies over which one or more adjacent radiators resonate. At least some of the frequencies in each range of frequencies differ from at least some of the frequencies in one or more other ranges of frequencies. In this manner, and during operation, each of the radiators 130, 132, 134 is capable of receiving different frequency signals and energizing the electrical microstrip feed line 114 in response to the received signals (in receive mode). Combinations of radiators may at times simultaneously energize the electrical microstrip feed line 114. In a similar fashion, a radio connected to the electrical microstrip feed line 114 may energize any of (or multiple ones of) the radiators 130, 132, 134, depending on the frequency (or frequencies) at which the radio operates in transmit mode.

By way of example, each of the radiators 130, 132, 134 shown in FIGS. 1 & 2 has a length, a width, and a rectangular shape. The lengths of the radiators 130, 132, 134 are oriented perpendicular to the gap 112 and extend between first and second opposite edges 136, 138 of the first planar conducting element 108. Because adjacent radiators have different lengths, the second edge has a stepped configuration (i.e., is a stepped edge). As shown in FIGS. 1 & 2, the stepped edge 138 is composed of a plurality of flat edge segments. In other embodiments, the radiators 130, 132, 134 could have other shapes, and the stepped edge 138 could take other forms. For example, each of its edge segments could be convex or concave, or the corners of the stepped edge 138 could be rounded or beveled. The edge 136 abuts the gap 112.

First and second ones of the radiators 130, 132 bound an open slot 140 in the first planar conducting element 108. The open slot 140 has an orientation that is perpendicular to the gap 112. Thus, the open slot 140 opens away from the gap 112.

By way of example, the second and third radiators 132, 134 shown in FIGS. 1 & 2 abut each other (i.e., there is no slot between them). In other embodiments, a slot could be provided between each pair of adjacent radiators (e.g., between radiators 130 and 132, and between radiators 132 and 134.

The widths and lengths of the radiators 130, 132, 134 may be chosen to cause each radiator 130, 132, 134 to resonate over a particular range of frequencies. By way of example, and in the antenna 100, the length of the second radiator 132 is greater than the length of the first radiator 130, and the length of the third radiator 134 is greater than the length of the second radiator 132.

The second planar conducting element 110 provides a reference plane for both the electrical microstrip feed line 114 and the first planar conducting element 108, and in some embodiments may have a rectangular perimeter 142.

As shown in FIGS. 1 & 2, the second planar conducting element 110 has a hole 124 therein. The dielectric material 102 also has a hole 126 therein. By way of example, the holes 124, 126 are shown to be concentric and round. The hole 124 in the second planar conducting element 110 is larger than the hole 126 in the dielectric material 102, thereby exposing the first side 104 of the dielectric material 102 in an area adjacent the hole 126 in the dielectric material 102.

Figure 4:
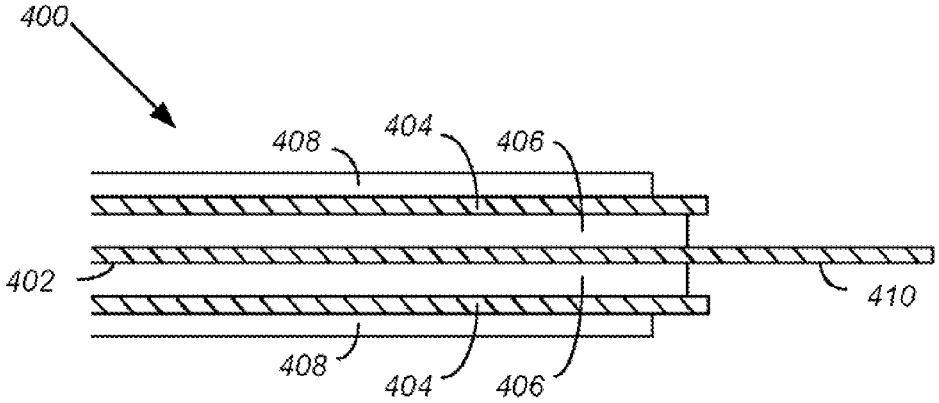
FIG. 4 illustrates a portion of a cross-section of an exemplary coax cable that may be electrically connected to the antenna shown in FIGS. 1-3.
Figure 7:
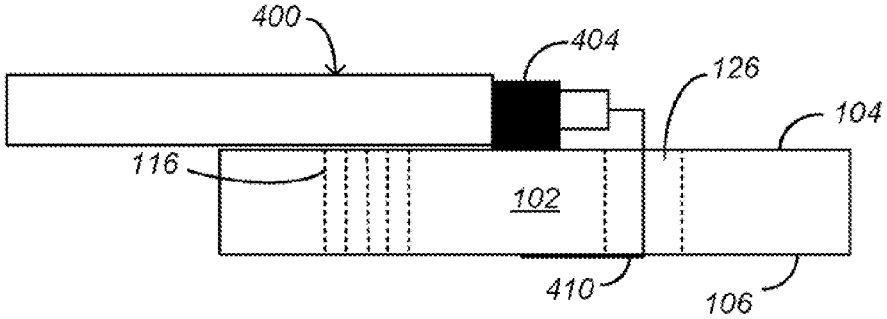
FIGS. 5-7 illustrate an exemplary connection of the coax cable shown in FIG. 4 to the antenna shown in FIGS. 1-3.
Figure 5:
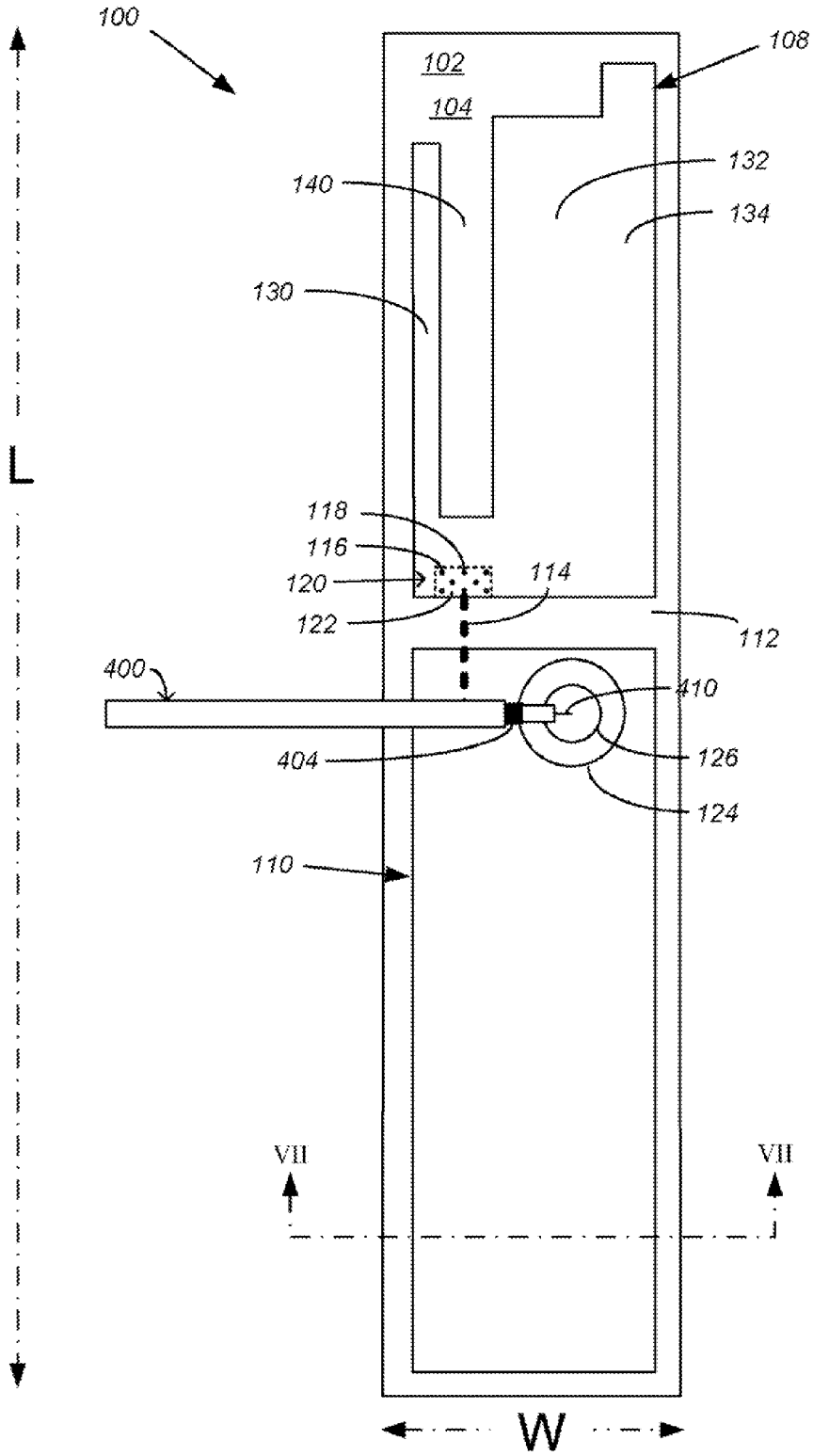
Figure 6:
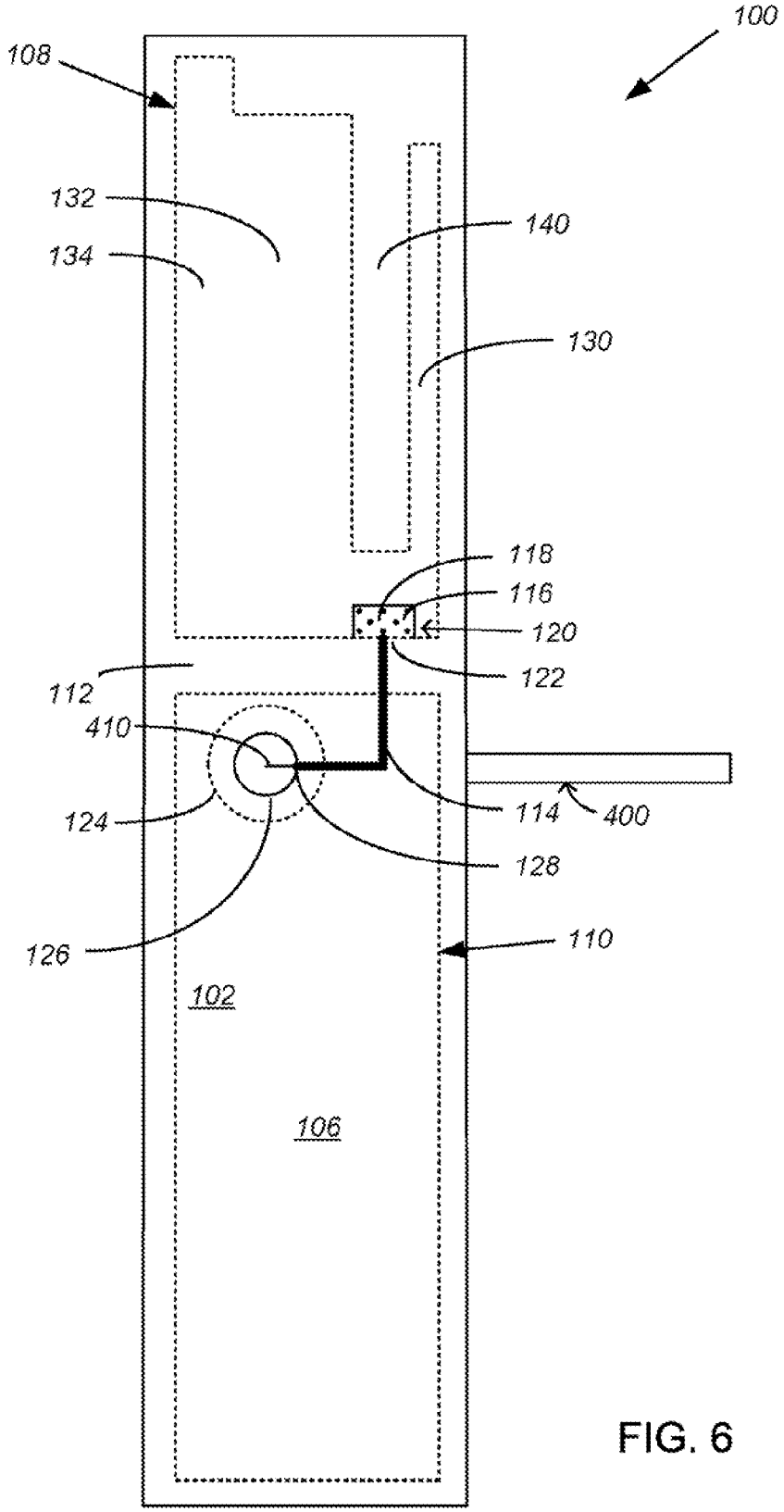

FIG. 4 illustrates a cross-section of a portion of an exemplary coax cable 400 that may be attached to the antenna 100, as shown in FIGS. 5-7. The coax cable 400 (FIG. 4) has a center conductor 402, a conductive sheath 404, and a dielectric 406 that separates the center conductor 402 from the conductive sheath 404. The coax cable 400 may also comprise an outer dielectric jacket 408. A portion 410 of the center conductor 402 extends from the conductive sheath 404 and the dielectric 406. The coax cable 400 is electrically connected to the antenna 100 by positioning the coax cable 400 adjacent the first side 104 of the antenna 100 and inserting the portion 410 of its center conductor 402 through the holes 124, 126 (see FIGS. 5 & 7). The center conductor 402 is then electrically connected to the electrical microstrip feed line 114 by, for example, soldering, brazing or conductively bonding the portion 410 of the center conductor 402 to the electrical microstrip feed line 114 (see FIGS. 6 & 7). The conductive sheath 404 of the coax cable 400 is electrically connected to the second planar conducting element 110 (also, for example, by way of soldering, brazing or conductively bonding the conductive sheath 404 to the second planar conducting element 110; see FIGS. 5 & 7). The exposed ring of dielectric material 102 adjacent the hole 126 in the dielectric material 102 can be useful in that it prevents the center conductor 402 of the coax cable 400 from shorting to the conductive shield 404 of the coax cable 400. In some embodiments, the coax cable 400 may be a 50 Ohm (Ω) coax cable.

The antenna 100 has a length, L, extending from the first planar conducting element 108 to the second planar conducting element 110. The length, L, crosses the gap 112. The antenna 100 has a width, W, that is perpendicular to the length. The coax cable 400 follows a route that is parallel to the width of the antenna 100. The coax cable 400 is urged along the route by the electrical connection of its conductive sheath 404 to the second planar conducting element 110, or by the electrical connection of its center conductor 402 to the electrical microstrip feed line 114.

In the antenna shown in FIGS. 1-3 & 5-7, the route of the electrical microstrip feed line 114 changes direction under the second planar conducting element 110. More specifically, the route of the electrical microstrip feed line 114 crosses the gap 112 parallel to the length of the antenna 100, then changes direction and extends parallel to the width of the antenna 100. The electrical microstrip feed line 114 may generally extend from the plurality of conductive vias 116, 118 to a termination point 128 adjacent the hole 126 in the dielectric material 102.

As previously mentioned, each of the radiators 130, 132, 134 of the first planar conducting element 108 has dimensions that cause it to resonate over a range of frequencies. The center frequencies and bandwidths of each frequency range can be configured by adjusting, for example, the length and width of each radiator 130, 132, 134. Although the perimeter of the first planar conducting element 108 is shown to have a plurality of straight edges, some or all of the edges may alternately be curved, or the perimeter of the first planar conducting element 108 may have a shape with a continuous curve. The center frequency and bandwidth of each frequency range can also be configured by configuring the positions and relationships of the radiators 130, 132, 134 with respect to each other, or with respect to one or more open slots 140.

Although the perimeter 142 of the second planar conducting element 110 is shown to have a plurality of straight edges, some or all of the edges may alternately be curved, or the perimeter 142 of the second planar conducting element 110 may have a shape with a continuous curve.

An advantage of the antenna 100 shown in FIGS. 1-3 & 5-7 is that the antenna 100 operates in multiple bands, and with an omni-directional azimuth, small size and high gain. By way of example, the antenna 100 shown in FIGS. 1-3 & 5-7 has been constructed in a form factor having a width of about 7 millimeters (7 mm) and a length of about 38 mm. In such a form factor, and with the first and second planar conducting elements 108, 110 configured as shown in FIGS. 1-3 & 5-7, the first radiator 130 has been configured to resonate in a first range of frequencies extending from about 3.3 Gigahertz (GHz) to 3.8 GHz, the second radiator 132 has been configured to resonate in a second range of frequencies extending from about 2.5 GHz to 2.7 GHz, and the third radiator 134 has been configured to resonate in a third range of frequencies extending from about 2.3 to 2.7 GHz. Such an antenna is therefore capable of operating as a WiMAX or LTE antenna, resonating at or about the commonly used center frequencies of 2.3 GHz, 2.5 GHz and 3.5 GHz.

The antenna 100 shown in FIGS. 1-3 & 5-7 may be modified in various ways for various purposes. For example, the perimeters of the first and second planar conducting elements 108, 110 may take alternate forms, such as forms having: more or fewer edges than shown in FIGS. 1, 2, 5 & 6; straight or curved edges; or continuously curved perimeters. In some embodiments, the shape of either or both of the planar conducting elements 108, 110, the shape of part of a planar conducting element 108, 110, or the shape of a slot 140, may be defined by one or more interconnected rectangular conducting segments or slot segments. In some embodiments, the first planar conducting element 108 may be modified to have more or fewer slots.

For the antenna 100 shown in FIGS. 1-6, the dimensions of the electromagnetic radiators 130, 132, 134 cause the radiators to resonate over non-overlapping (or substantially non-overlapping) frequency ranges. However, in some embodiments, the radiators 130, 132, 134 could be sized or shaped to resonate over overlapping frequency ranges.

In some embodiments, the holes 124, 126 in the second planar conducting element 110 and dielectric material 102 may be sized, positioned and aligned as shown in FIGS. 1, 2, 5 & 6. In other embodiments, the holes 124, 126 may be sized, positioned or aligned in different ways. As defined herein, "aligned" holes are holes that at least partially overlap, so that an object may be inserted through the aligned holes. Though FIG. 1 illustrates holes 124, 126 that are sized and aligned such that the first side 104 of the dielectric material 102 is exposed adjacent the hole 126 in the dielectric material 102, the first side 104 of the dielectric material 102 need not be exposed adjacent the hole 126.

In some embodiments, the plurality of conductive vias 116, 118 shown in FIGS. 1, 2, 5 & 6 may comprise more or fewer vias; and in some cases, the plurality of conductive vias 116, 118 may consist of only one conductive via. Despite the number of conductive vias 116, 118 provided at a connection site 120, the rectangular conductive pad 122 may be replaced by a conductive pad having another shape; or, one or more conductive vias 116, 118 may be electrically connected directly to the electrical microstrip feed line 114 (i.e., without use of the pad 122). In some embodiments, the via(s) 116, 118 are located between the open slot 140 and the gap 112 (though in other embodiments, the via(s) 116, 118 can be located in other positions).

In FIGS. 1, 2, 5 & 6, and by way of example, the gap 112 between the first and second planar conducting elements 108, 110 is shown to be rectangular and of uniform width. Alternately, the gap 112 could have other configurations.

Figure 8:
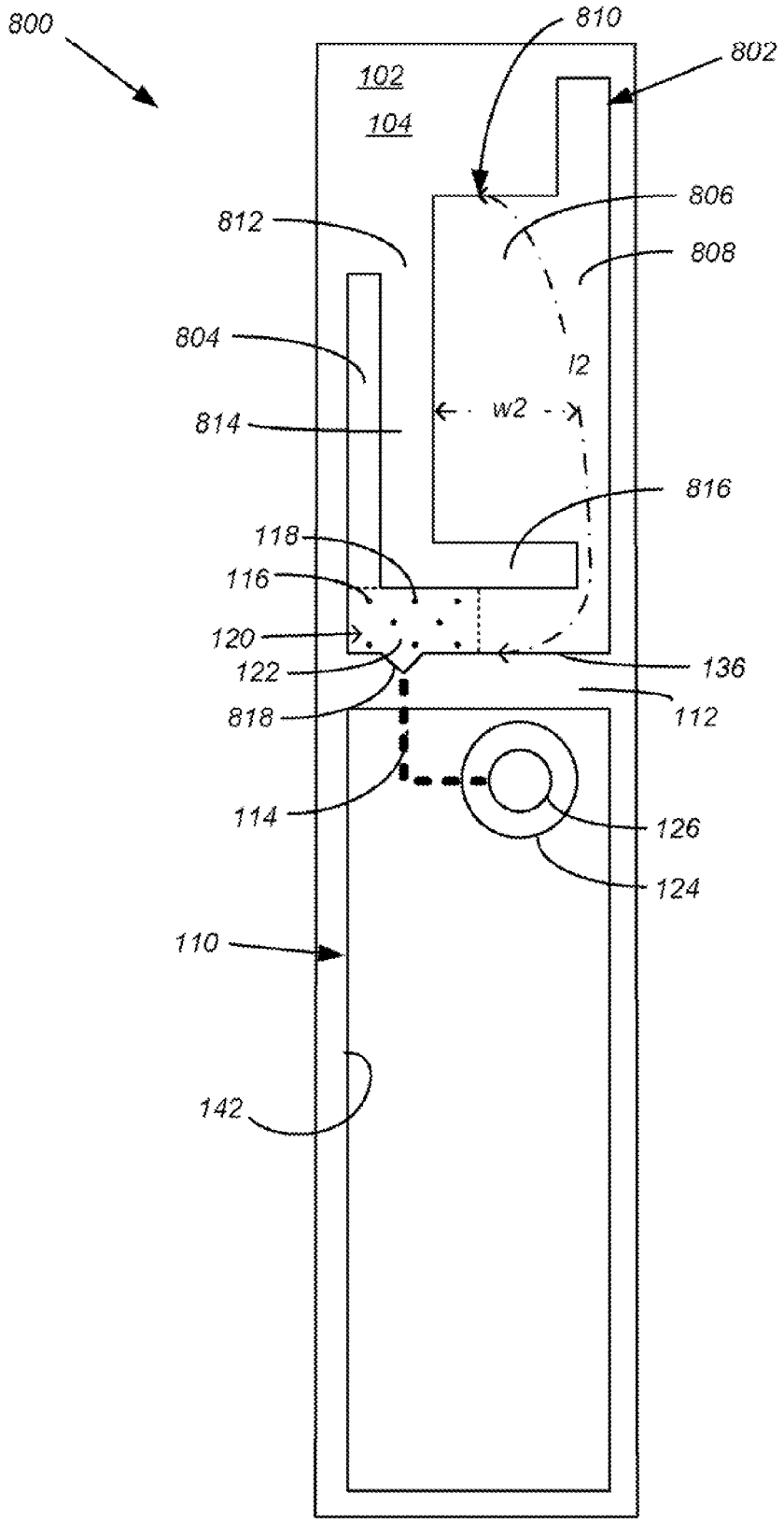
FIG. 8 illustrates a second exemplary embodiment of an antenna having first and second planar conducting elements, one of which comprises a plurality of electromagnetic radiators and an open slot and is electrically connected to an electrical microstrip feed line.
Figure 9:
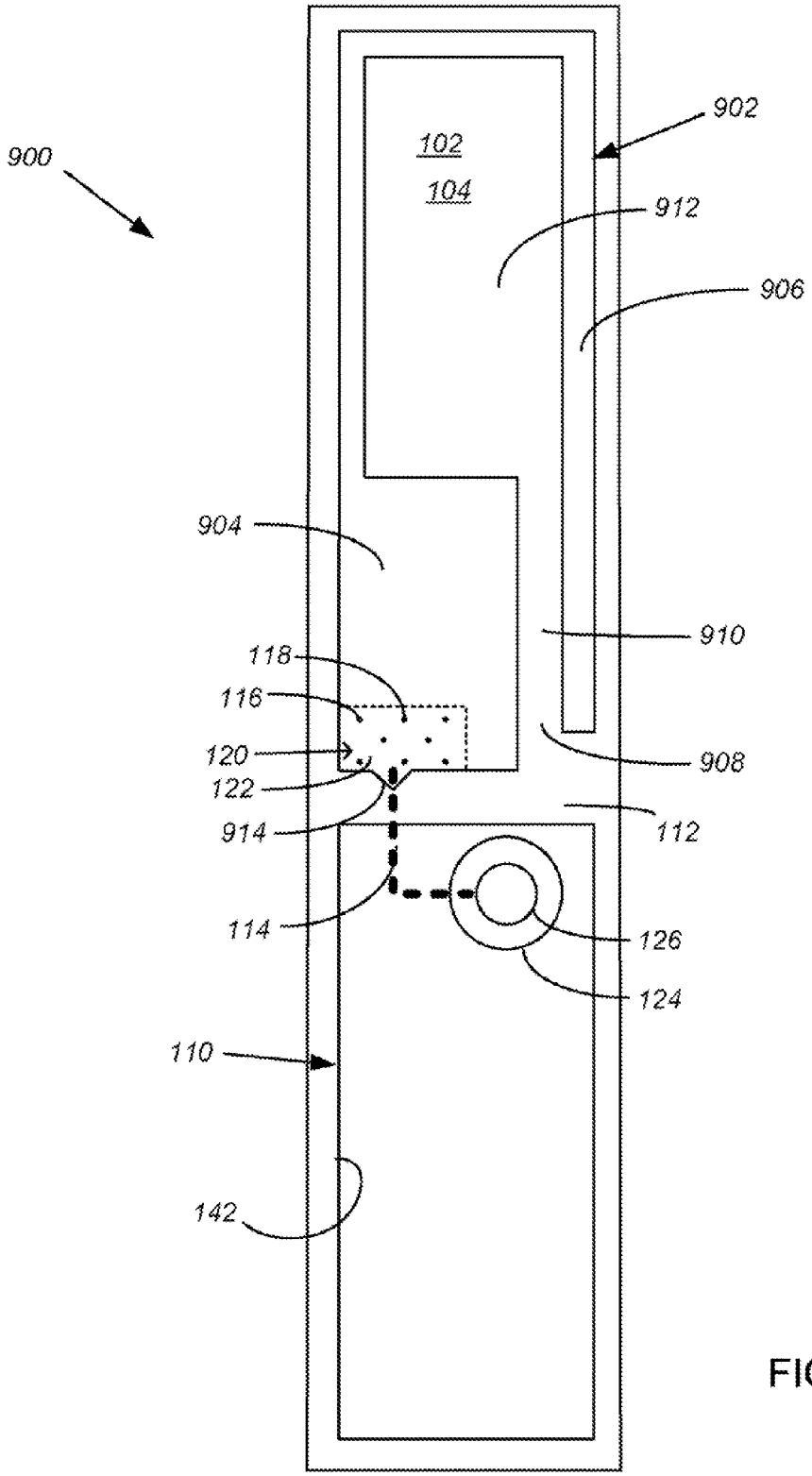
FIG. 9 illustrates a third exemplary embodiment of an antenna having first and second planar conducting elements, one of which comprises a plurality of electromagnetic radiators and an open slot and is electrically connected to an electrical microstrip feed line.

By way of example, FIGS. 8 & 9 illustrate gaps 112 wherein conductive protrusions 818, 914 of the antennas' first planar conducting elements 802, 902 extend into the gaps 112. As shown, these protrusions 818, 914 may take the form of triangular protrusions (i.e., the protrusions 818, 914 are small triangles). However, in alternate embodiments, the protrusions 818, 914 may take other forms and have rectangular or elliptical shapes. The electrical microstrip feed lines 114 may cross the gaps 112 at the protrusions 818, 914 (i.e., cross the protrusions 818, 914). The sizes and shapes of the protrusions 818, 914, as well as the manners in which the electrical microstrip feed lines 1106 cross the protrusions 818, 914, are factors in determining the LC resonances of the antennas 800 and 900, and thus the resonant frequencies of the antennas 800, 900. The configurations of the protrusions 818, 914 can also be used to adjust return loss and bandwidth of the antennas 800, 900. Use of the protrusions 818, 914 is advantageous over implementing a stand-alone capacitor, because they do not result in a significant power draw, and because they can eliminate the need for an extra component (i.e., a separate capacitor). Although protrusions 818 and 914 are only shown in the gaps 112 of the antennas 800, 900 illustrated in FIGS. 8 & 9, it is noted that the planar conducting element 108 shown in FIGS. 1 & 2 can be modified to include a protrusion that extends into the gap 112.

The operating bands of an antenna that is constructed as described herein may be contiguous or non-contiguous. In some cases, each operating band may cover part or all of a standard operating band, or multiple standard operating bands. However, it is noted that increasing the range of an operating band can in some cases narrow the gain of the operating band.

FIG. 8 illustrates a second exemplary embodiment of an antenna (i.e., an antenna 800) having first and second planar conducting elements 802, 110. For the most part, the elements of the antenna 800 can take forms that are the same or similar to the elements of the antenna 100 (FIG. 1), and the elements of the antenna 800 may be modified in ways that are the same or similar to the ways in which the elements of the antenna 100 may be modified. However, the antenna 800 differs from the antenna 100 in that the shape of its first conducting element 802 differs from the shape of the first conducting element 108.

Similarly to the first conducting element 108 of the antenna 100, the first conducting element 802 of the antenna 800 comprises three electromagnetic radiators 804, 806, 808, and each of the electromagnetic radiators 804, 806, 808 terminates (at one end) at a stepped edge 810. However, in addition to the slot 812 having a segment 814 oriented perpendicular to the gap 112, the slot 812 also has a segment 816 oriented parallel to the gap 112. The parallel segment 816, in combination with the segment 814, enables the radiators 804 and 806 to have longer electrical lengths (such as length "l2") while still being contained in a relatively compact area. The parallel segment 816 also increases the electromagnetic separation and independence of the radiator 804 with respect to the radiators 806 and 808, thereby providing a larger electrical "step" between the radiators 804 and 806.

In one embodiment of the antenna 800, the dimensions of the first radiator 804 may be tuned to cause it to resonate over a first range of frequencies extending from about 4.9 GHz to 5.9 GHz. The dimensions of the second radiator 806 may be tuned to cause it to resonate over a second range of frequencies extending from about 2.5 GHz to 2.7 GHz. The dimensions of the third radiator 134 may be tuned to cause it to resonate over a third range of frequencies extending from about 2.3 to 2.7 GHz. Such an antenna 800 is therefore capable of operating, for example, as a dual band Wi-Fi antenna resonating at or about the center frequencies of 2.4 GHz and 5.0 GHz.

FIG. 9 illustrates a third exemplary embodiment of an antenna (i.e., an antenna 900) having first and second planar conducting elements 902, 110. For the most part, the elements of the antenna 900 can take forms that are the same or similar to the elements of the antenna 100 (FIG. 1), and the elements of the antenna 900 may be modified in ways that are the same or similar to the ways in which the elements of the antenna 100 may be modified. However, the antenna 900 differs from the antenna 100 in that the shape of its first conducting element 902 differs from the shape of the first conducting element 108.

The first conducting element 902 of the antenna 900 comprises two electromagnetic radiators 904, 906 and an open slot 908. The open slot 908 opens toward the gap 112 and has both a segment 910 oriented perpendicular to the gap 112, and a segment 912 oriented parallel to the gap 112. The configuration of the open slot 908 enables the radiator 906 to have a longer electrical length while still being contained in a relatively compact area. The configuration of the open slot 908 also increases the electromagnetic separation and independence between the radiators 904 and 906.

In one embodiment of the antenna 900, the dimensions of the first radiator 904 may be tuned to cause it to resonate over a first range of frequencies extending from about 1.8 GHz to 2.2 GHz, and the dimensions of the second radiator 906 may be tuned to cause it to resonate over a second range of frequencies extending from about 870 MHz to 960 MHz. Such an antenna 900 is therefore capable of operating as a 3G antenna (i.e., as an antenna that supports the third generation services specified by the International Mobile Telecommunications-2000 (IMT-2000) standard).

Figure 10:
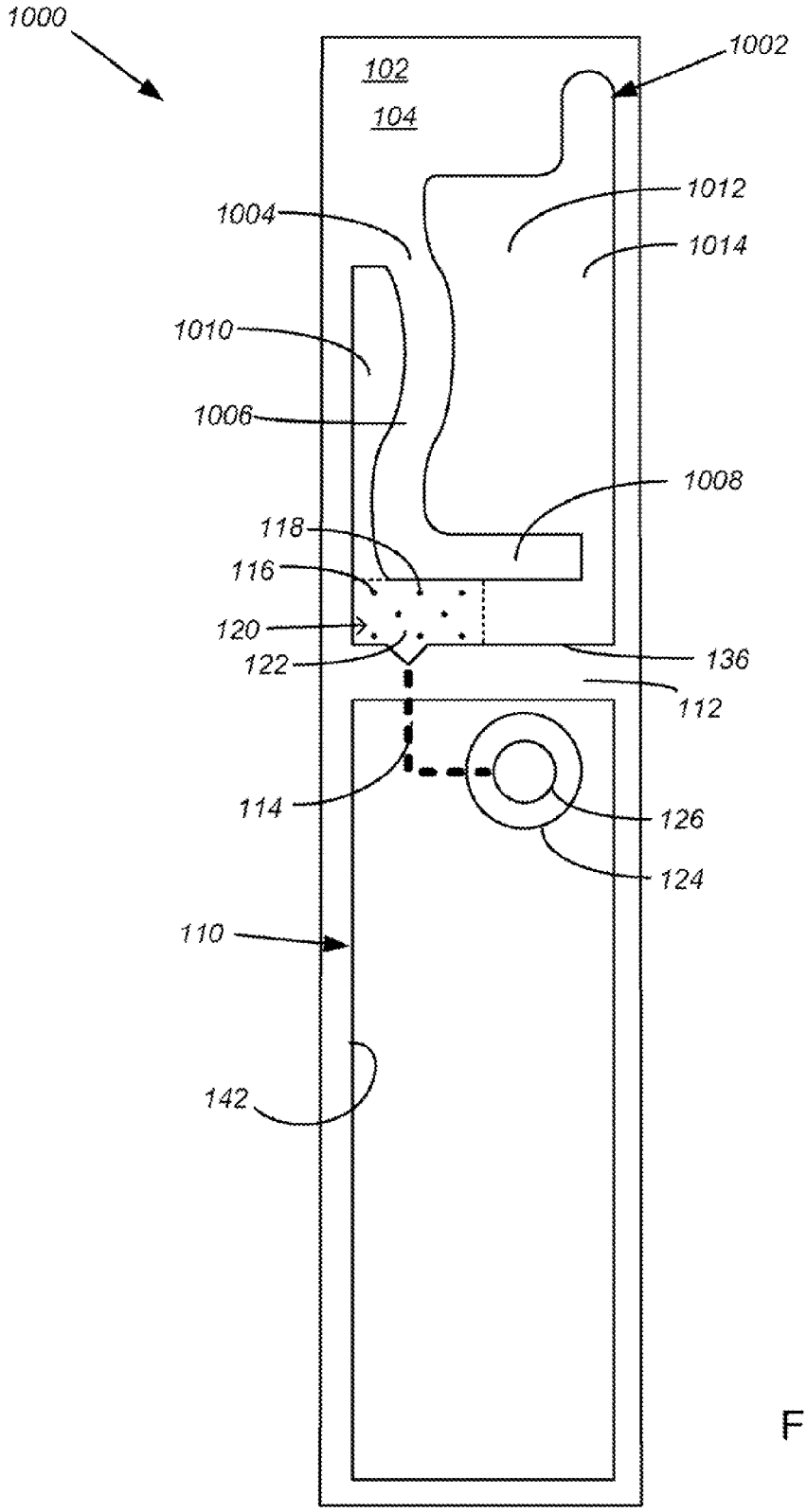
FIG. 10 illustrates a fourth exemplary embodiment of an antenna having first and second planar conducting elements, one of which comprises a plurality of electromagnetic radiators and an open slot and is electrically connected to an electrical microstrip feed line.

In other antenna embodiments having first and second planar conductors, wherein the first planar conductor has a plurality of electromagnetic radiators and an open slot, and wherein at least first and second ones of the antenna's radiators bound the open slot, the open slot may 1) open toward a gap between the first and second planar conductors, or 2) open toward any side, edge or boundary of the first planar conducting element. The electromagnetic conductors and open slot may also have any of a variety of configurations or shapes. For example, FIG. 10 illustrates an antenna 1000 having a configuration that is similar to the configuration of the antenna 800 shown in FIG. 8, but for the configuration of its first planar conducting element 1002. In particular, the first planar conducting element 1002 comprises an open slot 1004 having both a curved segment 1006 and a generally straight segment 1008. The first planar conducting element 1002 also comprises first, second and third electromagnetic radiators 1008, 1010, 1012 which have one or more curved edges.

Figure 11:
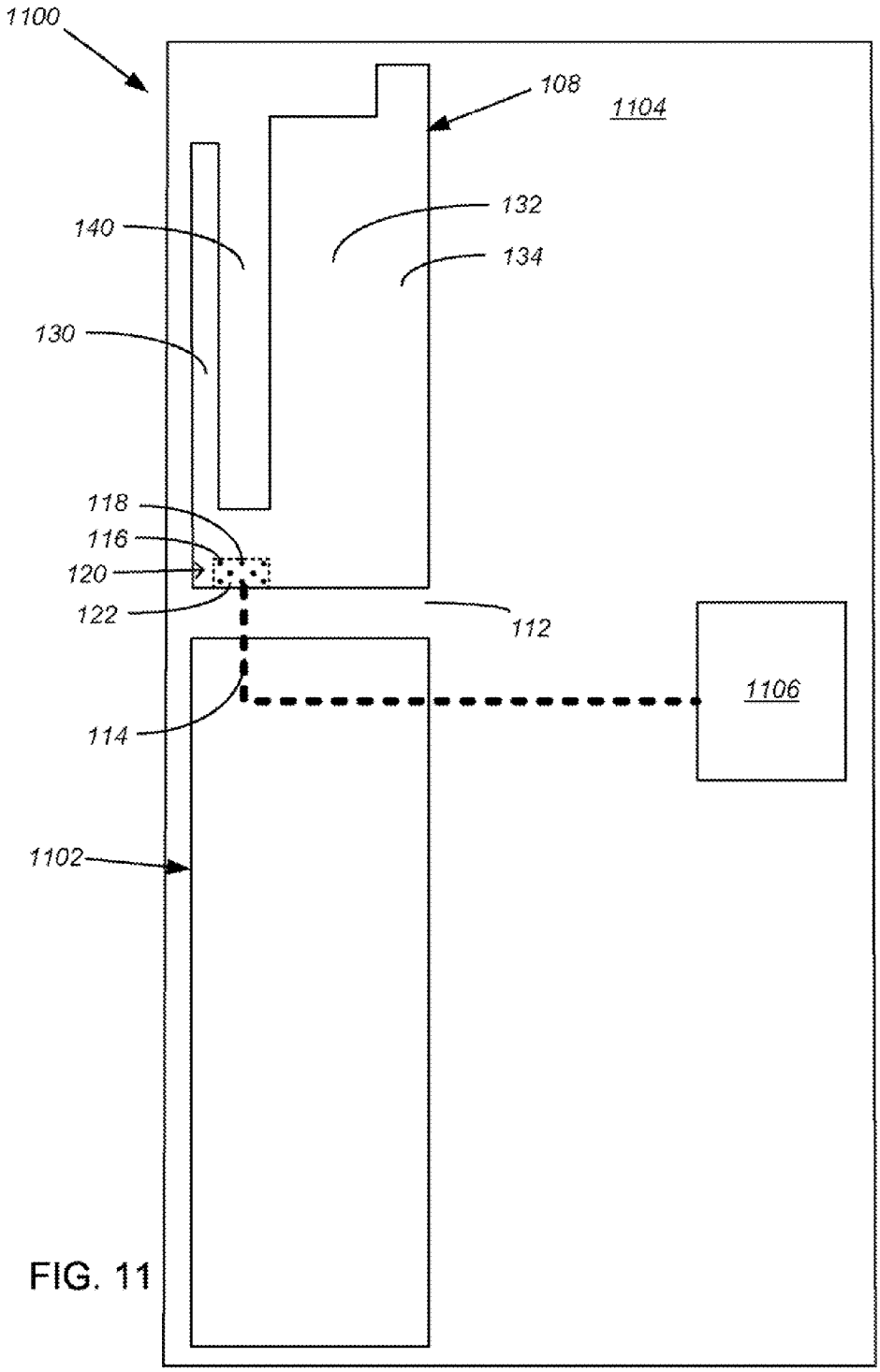
FIGS. 11 & 12 illustrate a fourth exemplary embodiment of an antenna having first and second planar conducting elements, one of which comprises a plurality of electromagnetic radiators and an open slot and is electrically connected to an electrical microstrip feed line.
Figure 12:
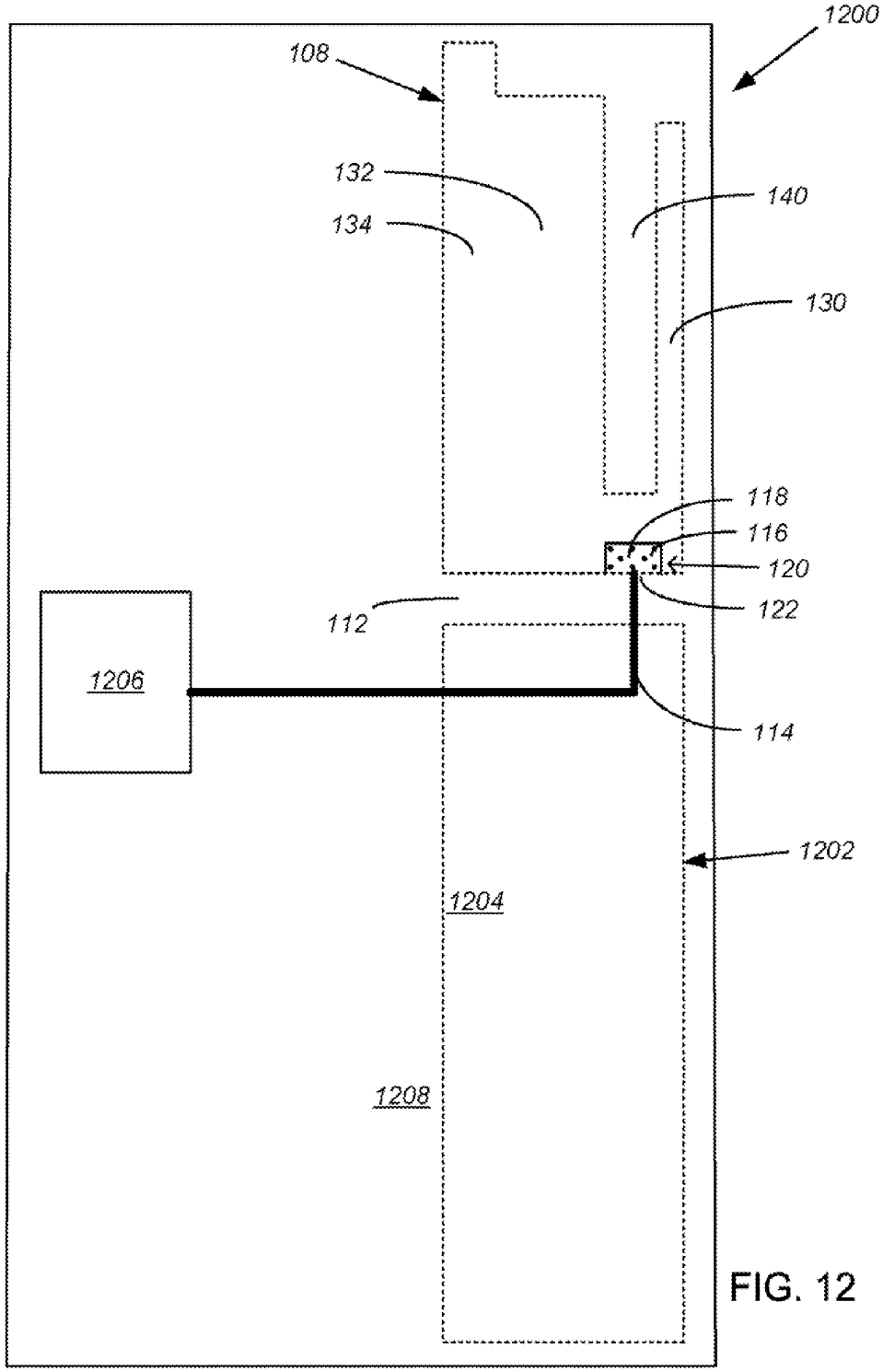

FIGS. 11 & 12 illustrate a variation 1100 of the antenna 100 shown in FIGS. 1-3 & 5-7, wherein the holes in the second planar conducting element 1102 and dielectric material 1104, and the coax cable passing through the holes, have been eliminated. The electrical microstrip feed line 114 is extended, or another feed line (e.g., another microstrip feed line) is joined to it, to electrically connect the electrical microstrip feed line 114 to a radio 1106. The second planar conducting element 1104 may be connected to a ground potential, such as a system or local ground that is shared by the radio 1106.

In some cases, the radio 1106 may be mounted on the same dielectric material 1104 as the antenna 1100. To avoid the use of additional conductive vias or other electrical connection elements, the radio 1106 may be mounted on the second side 1108 of the dielectric material 1104 (i.e., on the same side of the dielectric material 1104 as the electrical microstrip feed line 114). The radio 1106 may comprise an integrated circuit.

The antennas 800, 900, 1000 shown in FIGS. 8, 9 & 10, and antennas with other configurations of electromagnetic radiators, can also be connected to a coax cable (as shown in FIGS. 4 & 5) or to a radio 1106 mounted on the same dielectric as the antenna (as shown in FIGS. 11 & 12).

What is claimed is:

1. An antenna, comprising:

a dielectric material having i) a first side opposite a second side, and ii) a conductive via therein;

a first planar conducting element on the first side of the dielectric material, the first planar conducting element having an electrical connection to the conductive via;

a second planar conducting element on the first side of the dielectric material, wherein the first and second planar conducting elements are separated by a gap that electrically isolates the first planar conducting element from the second planar conducting element; and an electrical microstrip feed line on the second side of the dielectric material, the electrical microstrip feed line electrically connected to the conductive via and having a route extending from the conductive via, to across the gap, to under the second planar conducting element, the second planar conducting element providing a reference plane for both the electrical microstrip feed line and the first planar conducting element;

wherein the first planar conducting element has a plurality of electromagnetic radiators, each radiator having dimensions that cause it to resonate over a range of frequencies that differs from a range of frequencies over which an adjacent radiator resonates, and at least first and second of the radiators bounding an open slot in the first planar conducting element; and wherein the first planar conducting element has a conductive protrusion extending into the gap.

2. The antenna of claim 1, wherein the open slot has an orientation perpendicular to the gap.

3. The antenna of claim 1, wherein the open slot has a first segment that is perpendicular to the gap and a second segment that is parallel to the gap.

4. The antenna of claim 1, wherein at least one of the group consisting of the electromagnetic radiators and the open slot has a curved edge.

5. The antenna of claim 1, wherein each radiator has a length and a width, the lengths of the radiators having orientations perpendicular to the gap.

6. The antenna of claim 1, wherein a third of the radiators abuts the second of the radiators.

7. The antenna of claim 6, wherein the length of the second radiator is greater than the length of the first radiator, and wherein the length of the third radiator is greater than the length of the second radiator.

8. The antenna of claim 1, wherein the first planar conducting element electrically connects to the conductive via between the open slot and the gap.

9. The antenna of claim 1, wherein the first planar conducting has a third radiator.

10. The antenna of claim 1, wherein the second planar conducting element has a rectangular perimeter.

11. The antenna of claim 1, wherein each of the radiators has a rectangular shape.

12. The antenna of claim 1, wherein the dielectric material comprises FR4.

13. The antenna of claim 1, wherein the second planar conducting element has a hole therein, and the dielectric material has a hole therein, the hole in the second planar conducting element and the hole in the dielectric material being aligned.

14. The antenna of claim 13, wherein the hole in the second planar conducting element is larger than the hole in the dielectric material, thereby exposing the first side of the dielectric material adjacent the hole in the dielectric material.

15. The antenna of claim 13, further comprising a coax cable having a center conductor, a conductive sheath, and a dielectric separating the center conductor from the conductive sheath, wherein the center conductor extends through the hole in the second planar conducting element and the hole in the dielectric material, wherein the center conductor is electrically connected to the electrical microstrip feed line, and wherein the conductive sheath is electrically connected to the second planar conducting element.

16. The antenna of claim 15, wherein:

the antenna has a length extending from the first planar conducting element to the second planar conducting element, the length crossing the gap;

the antenna has a width perpendicular to the length; and the coax cable follows a route that is parallel to the width of the antenna, the coax cable being urged along the route by the electrical connection of the conductive sheath to the second planar conducting element.

17. The antenna of claim 1, wherein the route of the electrical microstrip feed line changes direction under the second planar conducting element.

18. The antenna of claim 1, wherein:

the antenna has a length extending from the first planar conducting element to the second planar conducting element, the length crossing the gap;

the antenna has a width perpendicular to the length; and the route of the electrical microstrip feed line crosses the gap parallel to said length, then changes direction and extends parallel to said width.

19. The antenna of claim 1, wherein:

the dielectric material has a plurality of conductive vias therein, of which the conductive via is one, and wherein each of the plurality of conductive vias is positioned proximate to others of the conductive vias at a connection site; and each of the electrical microstrip feed line and the first planar conducting element is electrically connected to each of the plurality of conductive vias.

20. The antenna of claim 1, further comprising a radio on the dielectric material, wherein the electrical microstrip feed line is electrically connected to the radio.

21. The antenna of claim 20, wherein the radio is on the second side of the dielectric material.

22. The antenna of claim 20, wherein the radio comprises an integrated circuit.

23. The antenna of claim 1, wherein the conductive protrusion is triangular.

24. An antenna, comprising:

a dielectric material having i) a first side opposite a second side, and ii) a conductive via therein;

a first planar conducting element on the first side of the dielectric material, the first planar conducting element having an electrical connection to the conductive via;

a second planar conducting element on the first side of the dielectric material, wherein the first and second planar conducting elements are separated by a gap that electrically isolates the first planar conducting element from the second planar conducting element; and an electrical microstrip feed line on the second side of the dielectric material, the electrical microstrip feed line electrically connected to the conductive via and having a route extending from the conductive via, to across the gap, to under the second planar conducting element, the second planar conducting element providing a reference plane for both the electrical microstrip feed line and the first planar conducting element;

wherein the first planar conducting element has a plurality of electromagnetic radiators, each radiator having dimensions that cause it to resonate over a range of frequencies that differs from a range of frequencies over which an adjacent radiator resonates, and at least first and second of the radiators bounding an open slot in the first planar conducting element; and wherein the open slot opens toward the gap.

25. An antenna, comprising:

a dielectric material having i) a first side opposite a second side, and ii) a conductive via therein;

a first planar conducting element on the first side of the dielectric material, the first planar conducting element having i) an electrical connection to the conductive via, and ii) a first edge opposite a second edge, the second edge being a stepped edge, wherein each step defines an electromagnetic radiator or an open slot in the first planar conducting element;

a second planar conducting element on the first side of the dielectric material, wherein the first and second planar conducting elements are separated by a gap that electrically isolates the first planar conducting element from the second planar conducting element, wherein the first edge of the first planar conducting element abuts the gap, and wherein the first planar conducting element has a conductive protrusion extending into the gap; and an electrical microstrip feed line on the second side of the dielectric material, the electrical microstrip feed line electrically connected to the conductive via and having a route extending from the conductive via, to across the gap, to under the second planar conducting element, the second planar conducting element providing a reference plane for both the electrical microstrip feed line and the first planar conducting element.

26. The antenna of claim 25, wherein the second planar conducting element has a hole therein, and the dielectric material has a hole therein, the hole in the second planar conducting element and the hole in the dielectric material being aligned.

27. The antenna of claim 26, further comprising a coax cable having a center conductor, a conductive sheath, and a dielectric separating the center conductor from the conductive sheath, wherein the center conductor extends through the hole in the second planar conducting element and the hole in the dielectric material, wherein the center conductor is electrically connected to the electrical microstrip feed line, and wherein the conductive sheath is electrically connected to the second planar conducting element.

28. The antenna of claim 25, wherein the route of the electrical microstrip feed line changes direction under the second planar conducting element.

29. The antenna of claim 25, wherein:

the dielectric material has a plurality of conductive vias therein, of which the conductive via is one, and wherein each of the plurality of conductive vias is positioned proximate to others of the conductive vias at a connection site; and each of the electrical microstrip feed line and the first planar conducting element is electrically connected to each of the plurality of conductive vias.

30. The antenna of claim 25, further comprising a radio on the dielectric material, wherein the electrical microstrip feed line is electrically connected to the radio.

31. An antenna, comprising:

a dielectric material having i) a first side opposite a second side, and ii) a conductive via therein;

a first planar conducting element on the first side of the dielectric material, the first planar conducting element having i) an electrical connection to the conductive via, ii) a plurality of electromagnetic radiators, and iii) an open slot bounded by at least first and second of the electromagnetic radiators;

a second planar conducting element on the first side of the dielectric material, wherein the first and second planar conducting elements are separated by a gap that electrically isolates the first planar conducting element from the second planar conducting element, and wherein the first planar conducting element has a conductive protrusion extending into the gap; and an electrical microstrip feed line on the second side of the dielectric material, the electrical microstrip feed line electrically connected to the conductive via and having a route extending from the conductive via, to across the gap, to under the second planar conducting element, the second planar conducting element providing a reference plane for both the electrical microstrip feed line and the first planar conducting element.

* * * * *